US005215482A

United States Patent [19]

Henry

[11] Patent Number: 5,215,482

[45] Date of Patent: Jun. 1, 1993

[54] APPARATUS FOR FORWARD FACING BOAT ROWING

[76] Inventor: Harold S. Henry, 4221 W. Armour St., Seattle, Wash. 98199-3016

[21] Appl. No.: 712,551

[22] Filed: Jun. 10, 1991

[51] Int. Cl.[5] ..... B63H 16/10

[52] U.S. Cl. ..... 440/25; 440/103; 440/104; 416/74

[58] Field of Search ..... 440/25, 101, 102, 103, 440/104, 105; 416/74

[56] References Cited

U.S. PATENT DOCUMENTS 49,930 9/1865 Smith ..... 440/25
88,013 3/1969 Connor ..... 440/104 X

FOREIGN PATENT DOCUMENTS 158752 11/1919 United Kingdom ..... 440/104

*Primary Examiner*—Sherman Basinger
*Attorney, Agent, or Firm*—Graybeal Jackson Haley & Johnson

[57] ABSTRACT

An apparatus for forward facing rowing of a boat is disclosed. An elongate outrigger support extends outwardly from a mounting point in the boat and has an end adjacent to the mounting point around which the elongate outrigger support pivots horizontally. An outrigger support and handle connector sleeve is slidably mounted over the elongate outrigger support. An elongate handle is pivotally connected to the sleeve to allow the elongate handle to pivot relative to both the sleeve and the outrigger support. A handle and oar connector attaches the outboard end of the elongate handle to an oar within the midsection of the oar. A rotation transfer mechanism in the handle and oar connector causes corresponding rotation of the oar upon rotation of the elongate handle. The handle and oar connector transfers, from the elongate handle to the oar, pivotal and rotational movement as the elongate handle rotates, as well as moves along and pivots around the elongate outrigger support. An oar and boat connector attaches the inboard end of the oar to the boat and allows rotational and pivotal movement of the oar for rowing motion in response to movement by the elongate handle.

21 Claims, 9 Drawing Sheets

APPARATUS FOR FORWARD FACING BOAT ROWING

BACKGROUND OF THE INVENTION

The present invention pertains to an apparatus for forward-facing rowing of a boat or scull.

The benefits of forward-facing rowing, including safer and more enjoyable rowing, are readily apparent. Patents that disclose various types of mechanisms for rowing facing forward include U.S. Pat. Nos. 4,943,250, 4,867,718, and 4,776,821 all issued to duPont; U.S. Pat. No. 4,623,314 issued to Waugh; and U.S. Pat. No. 4,383,830 issued to Cartwright.

However, none of the above patents discloses a rowing apparatus that duplicates the rowing motion of conventionally operated oars, including full pivotal oar motion, as well as oar rotation that alters the angular orientation of the oar face (known as "feathering"). Additionally, none of the above patents discloses an apparatus that is biased against the weight of the oar to duplicate the heft of a conventional oar mounted to the boat at the midsection, or "leather," portion of the oar.

Furthermore, none of the above patents discloses a mechanism that provides rowing performance better than the performance attained by conventional rowing. Specifically, the above patents do not teach the use of a longer effective oar length than is conventional, achieved by pivoting the oar around its inboard end rather than around its "leather" located in the mid-section of the oar. This lengthening of the effective oar radius reduces the arc described by the oar blade in traversing a stroke of standard length, from an arc of about 90 degrees in length to an arc of about 60 degrees. The result is a more effective delivery of power because a greater percentage of the oar blade's motion is parallel to the line of travel of the boat.

Also, none of the above patents teaches an apparatus that allows "feathering" of the oars with the stronger forearms as opposed to the weaker wrists employed in conventional rowing. Also, none of the above patents teaches a mechanism for delivery of power to the oars that can be easily constructed and maintained in such fashion that very little energy is lost to friction even under the heaviest use.

A need thus exists for a forward facing rowing apparatus having all of the above advantages lacking in the above patents.

SUMMARY OF THE INVENTION

The present invention is an apparatus for forward facing boat rowing. The apparatus includes an elongate outrigger support extending outwardly from an outrigger base mounted in the boat, around which base the elongate outrigger support pivots in a horizontal plane.

An outrigger support and handle connector sleeve is slidably mounted over the elongate outrigger support. An elongate handle adapted to be gripped by an oarsman is pivotally connected to the sleeve to allow pivotal movement of the elongate handle relative to both the sleeve and the outrigger support. The sleeve guides movement of the elongate handle along the length of the outrigger support.

A handle and oar connector attaches the outboard end of the elongate handle to the oar at a point in the midsection of the oar between one quarter and one half of the oar length from the inboard end of the oar. A rotation transfer mechanism in the handle and oar connector causes corresponding rotation of the oar upon rotation of the elongate handle. The handle and oar connector transfers, from the elongate handle to the oar, pivotal and rotational movement as the elongate handle rotates, as well as moves along and pivots around the elongate outrigger support.

An oar and boat connector attaches the inboard end of the oar to the inboard portion of the boat and allows rotational and pivotal movement of the oar for rowing motion in response to movement by the elongate handle.

In a preferred embodiment of the present invention, the oar and boat connector includes a first sleeve over the inboard end of the oar and a second sleeve over the first sleeve. The second sleeve allows rotation of the first sleeve and the oar relative to the second sleeve. A two-way hinge assembly connects the second sleeve to the boat and allows upward and downward movement and forward and backward movement of the oar relative to the boat. A spring connects the hinge assembly and the boat and is biased against the weight of the oar.

In another aspect of the preferred embodiment, the rotation transferring mechanism of the handle and oar connector includes a pulley wheel concentric with the outboard end of the elongate handle, and connected thereto by a flexible shaft. A belt around the pulley wheel and the oar causes rotation of the oar when the pulley wheel is rotated by rotation of the elongate handle.

In an alternate embodiment of the present invention, the rotation transferring mechanism of the handle and oar connector includes a toothed gear concentric with the outboard end of the elongate handle, and connected thereto by a flexible shaft. The teeth of the gear mesh with teeth disposed circumferentially around the oar such that rotation of the elongate handle causes rotation of the gear which in turn causes rotation of the oar.

In another alternate embodiment of the present invention, the apparatus includes an outrigger connected to the side wall of the boat and an oar-to-outrigger connector that parallels the above described oar and boat connector. The oar-to-outrigger connector attaches the outrigger end of the oar to the outrigger so that the oar is disposed across the boat with the blade end of the oar on an opposite side of the boat from the outrigger end of the oar. The oar-to-outrigger connector allows pivotal and rotational movement of the oar by an oarsman directly gripping the oar.

BRIEF DESCRIPTION OF THE DRAWINGS

These and other features of the present invention will be more fully appreciated when considered in the light of the following specification and drawings in which.

DETAILED DESCRIPTION OF THE PREFERRED EMBODIMENT

The present invention is an apparatus for forward facing rowing of a boat or racing scull.

Figure 1A:
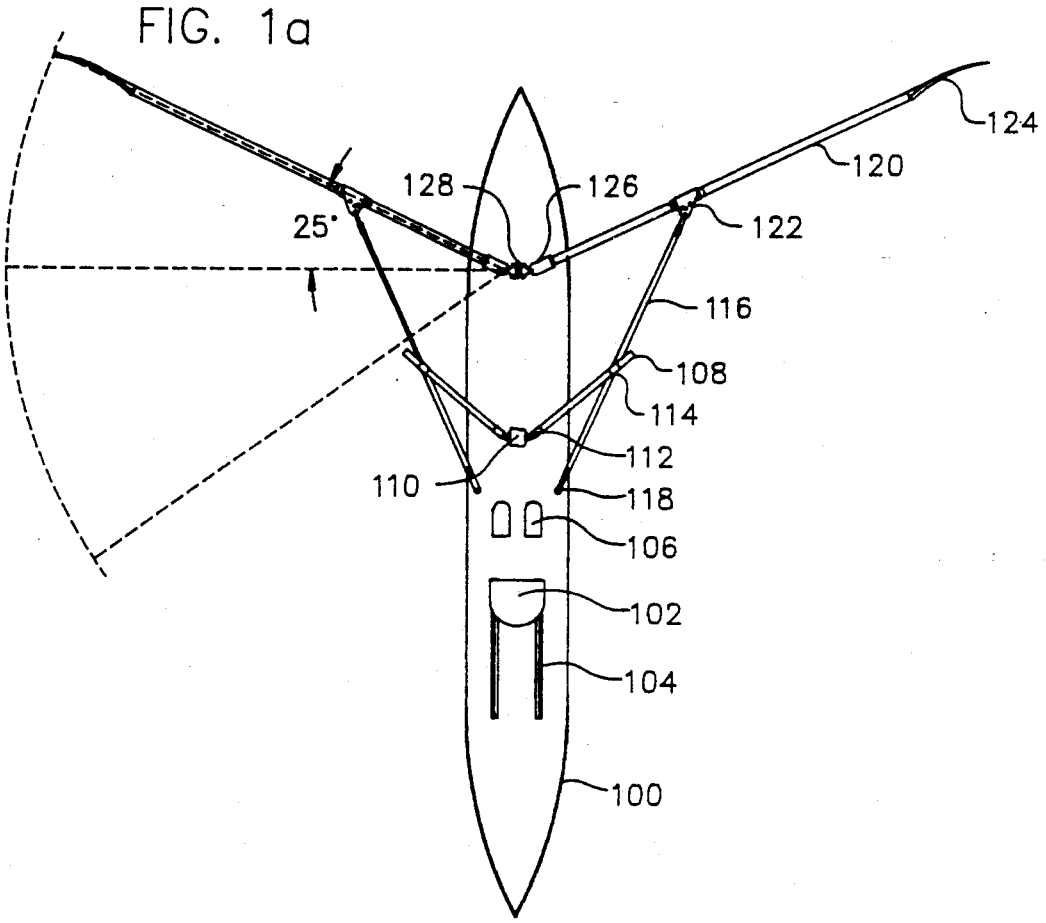
FIGS. 1*a* and 1*b* are top and side views respectively of the present invention mounted on a boat and showing the oar stroke beginning portion.
Figure 1B:
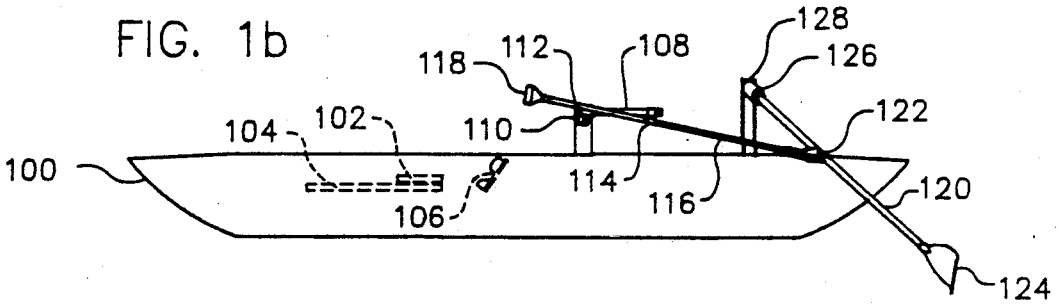

Referring first to FIGS. 1a and 1b, the overall configuration of the present invention is detailed. Scull 100 includes seat 102, which is oriented toward the front portion of scull 100 and mounted on two parallel longitudinal rails 104 for sliding thereon. Footpads 106 are adapted for support of the feet of the oarsman during rowing.

Outrigger supports 108 are elongate structures attached by outrigger support attachments 112 to outrigger base 110 mounted in scull 100. Outrigger support attachments 112 may be hinges known in the art which permit outrigger support 108 to move pivotally on outrigger base 110 in a horizontal plane relative to scull 100.

Outrigger support and handle connector sleeves 114 attach outrigger supports 108 and handles 116. Outrigger support and handle connector sleeves 114 are slidably mounted over outrigger supports 108, are fixedly connected to handles 116, and allow pivotal movement of handles 116 relative to outrigger supports 108 as well as movement of handles 116 along outrigger supports 108. Outrigger support and handle connector sleeves 114 are described in further detail below.

Handles 116 include grips 118 on each of the inboard ends of handles 116. Grips 118 are adapted to be held by an oarsman to cause rowing of scull 100.

The outboard ends of handles 116 are attached to oars 120 by handle and oar connectors 122 at a point in the mid section of oars 118 slightly outboard of the normal location of the oar "leathers." Handle and oar connectors 122 allow pivotal movement of handles 116 around oars 120 in a horizontal plane relative to scull 100. Handle and oar connectors 122 include an assembly for transferring rotational motion of handles 116 to oars 120, resulting in a rotation of oar blades 124 known as "feathering." Preferably, rotation of a handle 116 in one direction, e.g. clockwise looking from the oarsman's, perspective, will result in rotation of the corresponding oar blade 124 in the same direction, i.e. clockwise looking from the inboard end of the oar. Preferably, when grips 118 are oriented vertically, oar blades 124 will also be vertically positioned. When handles 116 are rotated by moving grips 118 to a horizontal orientation, oars 120 will be rotated at the same time so as to place oar blades 124 in a horizontal position.

Figure 2A:
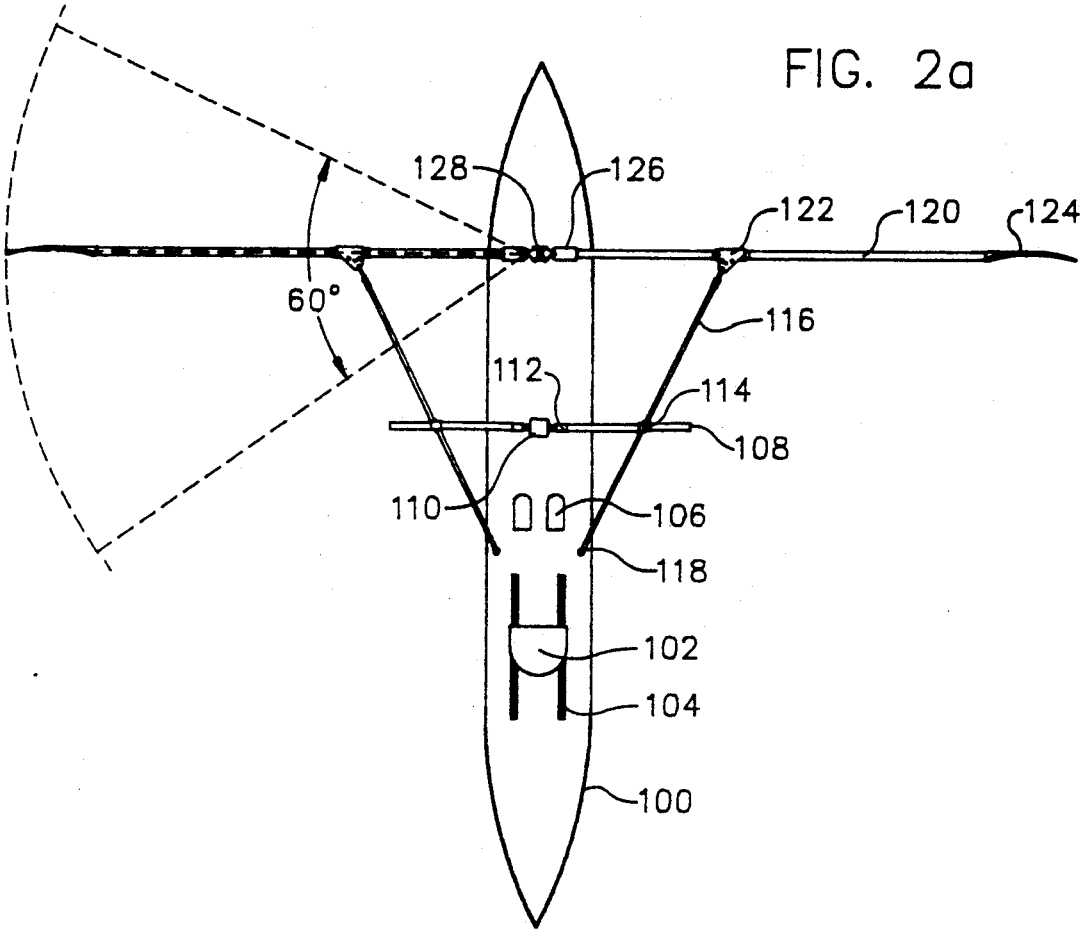
FIGS. 2*a* and 2*b* are top and side views respectively of the present invention mounted on a boat and showing the oar stroke middle portion.
Figure 3A:
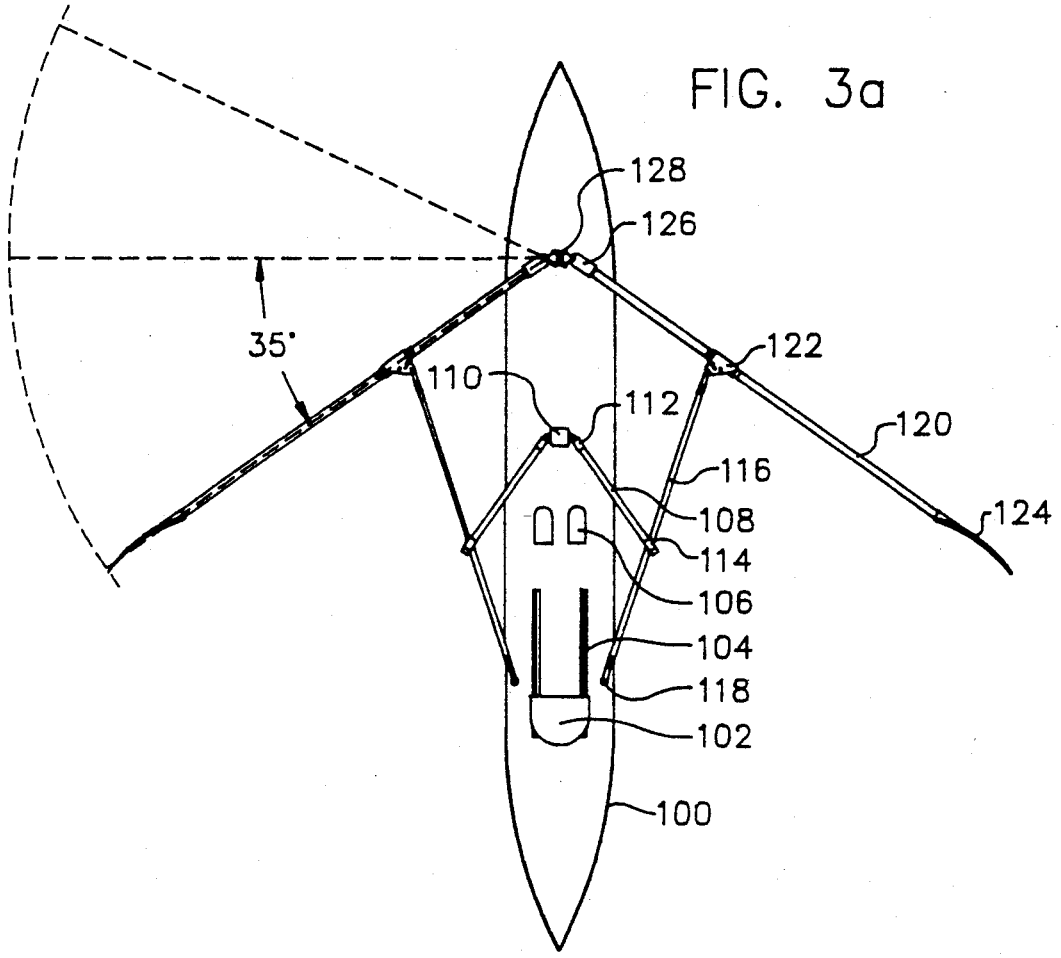
FIGS. 3*a* and 3*b* are top and side views respectively of the present invention mounted on a boat and showing the oar stroke end portion.
Figure 3B:
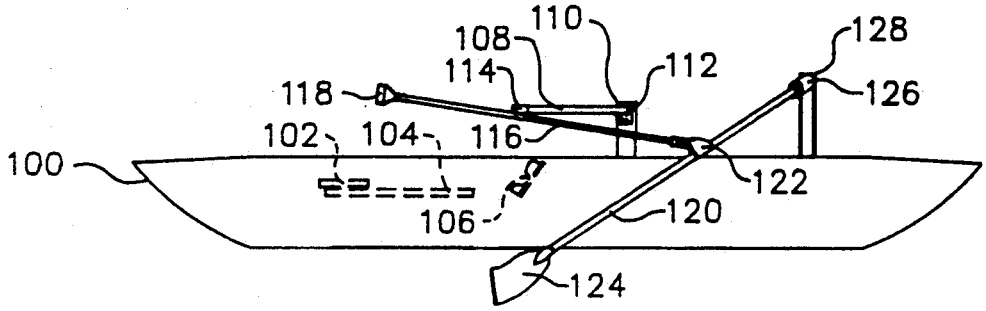

Oars 120 are inboardly attached to scull 100 by connection of each of the inboard ends of oars 120 to oar and boat connector 126. Oar and boat connector 126 is pivotally attached to oar support post 128 on scull 100. Oar and boat connector 126 allows rotation of oars 120, as well as free pivotal movement of oars 120 relative to scull 100, for oar movement substantially identical to oar motion of conventional sliding-seat rowing. Oar and boat connector 126 preferably includes a spring biased against the weight of the oar to produce the heft of an oar conventionally attached to the scull at the oar's "leather." Oar and boat connector 126 is described in further detail/below. Oar support post 128 is situated on scull 100 such that a smaller portion of the 60 oar power stroke extends towards the front of scull 100 than extends towards the rear of scull 100 (preferably about 25 degrees forward and about 35 degrees backward from the perpendicular, as shown in FIGS. 1a, 2a and 3a). Such skew in the stroke provides greatest effectiveness at the start of an oar power stroke to counteract the loss of inertia known in the art to be sustained during the preceding recovery stroke.

Referring now to FIGS. 1a, 1b, 2a, 2b, 3a, and 3b, the rowing operation of the present invention is described. The oarsman is situated in seat 102, facing toward the front portion of scull 100. FIGS. 1a and 1b show the beginning of an exemplary oar power stroke. Immediately prior to the beginning of such stroke, seat 102 is positioned at the forward end of rails 104; the oarsman's legs are bent so that his knees are close to his chest, and his body and arms are extended forward. The oarsman grasps grips 118 of handles 116 such that the grips 118 are in a horizontal plane and the oarsman's knuckles are facing upwards. The oar blades 124 are thus also horizontal relative to the water, with the rear face of oar blades 124 facing upwards. The oarsman's hands are held low so that the handles 116, by connection through handle and oar connectors 122, hold the blades 124 of oars 120 out of the water. In this initial forward position, immediately prior to the beginning of an exemplary power stroke, the handles 116, by connection through handle and oar connectors 122, hold the oars 120 angled towards the front portion of scull 100 and by connection through outrigger support and handle connector sleeves 114, likewise hold the outrigger supports 108 angled towards the front portion of scull 100.

To initiate the oar power stroke, the oarsman raises his hands to his chest level, thus raising the inboard ends of handles 116, lowering the outboard ends of handles 116, and lowering oars 120 around oar and boat connectors 126 so that oar blades 124 enter the water. In the same motion, the oarsman rotates his forearms and hands outwardly so that the grips 118 of handles 116 are in a perpendicular plane to the water. This arm and hand motion causes oar blades 124 to rotate to a perpendicular plane as a result of the transfer of rotation of handle 116 to oar 120 by handle and oar connector 122. In the resulting position, shown in FIGS. 1a and 1b, the oarsman is at the start of the oar power stroke.

Next, keeping his arms straight, the oarsman straightens his back and thrusts with his legs, sliding seat 102 along rails 104 towards the rear of scull 100 and pulling handles 116 towards the rear of scull 100. Handles 116, by connection through outrigger support and oar connector sleeves 114, thus slide along outrigger supports 108 and pivot relative to outrigger supports 108, causing outrigger supports 108 to move pivotally towards the rear of scull 100 around outrigger support attachments 112. Handles 116 also, by connection through handle and oar connectors 122, cause oars 120 to move pivotally towards the rear of scull 100 around oar and boat connectors 126, propelling oar blades 124 through the water towards the rear of scull 100, and urging scull 100 forward through the water.

Figure 2B:
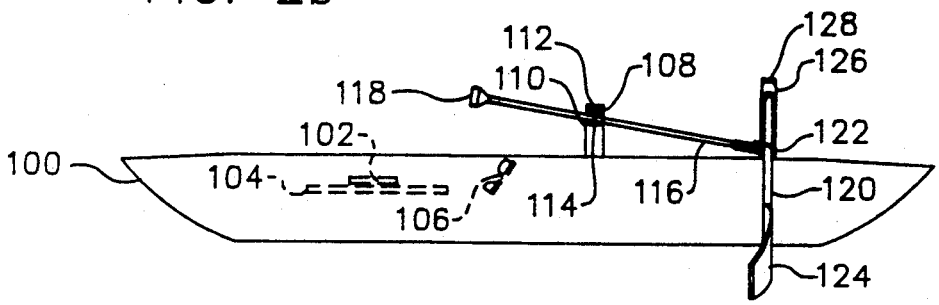

FIGS. 2*a* and 2*b* show the point in the exemplary oar power stroke at which the oarsman has used the actions described in the preceding paragraph to move oars 120 perpendicular to scull 100, also bringing outrigger supports 108 substantially perpendicular to scull 100. From this point, the oarsman continues to straighten his back and to thrust with his legs. In addition, he begins to bend his arms so as to bring his hands closer to his chest. Using all of these motions to pull handles 116 toward the rear of scull 100, he thus urges outrigger support and handle connector sleeves 114 to slide further along outrigger supports 108, and outrigger supports 108 and oars 120 to move pivotally towards the rear of scull 100. At the end of the exemplary power stroke, shown in FIGS. 3*a* and 3*b*, seat 102 is at the rear end of tracks 104, and oarsman's legs are fully extended. Oars 120 and outrigger supports 108 are oriented towards the rear of scull 100. Oarsman's back is straight and slightly inclined toward the rear of scull 100, and oarsman's hands are close to his chest. The oarsman now drops his hands from his chest into his lap, thus lowering handles 116 and raising oars 120 around oar and boat connector 126. In the same motion, the oarsman rotates his forearms and hands inwardly so that the grips 118 of handles 116 are in a horizontal plane again and the oarsman's knuckles are facing upwards. This arm and hand motion again causes oar blades 124 to rotate to a horizontal plane as a result of transfer of rotation of handles 116 to oar 120 by handle and oar connector 122.

With the oars 120 now out of the water, the recovery stroke begins. The oarsman leans his back forward and pushes his hands forward over his knees, then bends his legs, sliding seat 102 forward on rails 104 toward the front of scull 100. The oarsman's body and arm motion pushes handles 116 away from him and towards the front of scull 100. Handles 116 and outrigger support and handle connector sleeves 114 thus slide along outrigger supports 108, and handles 116 pivot relative to outrigger supports 108 and to outrigger support and handle connector sleeves 114. Outrigger supports 108 and oars 120 are thus pivotally urged forward toward the front portion of scull 100 to the starting stroke orientation initially described above.

Figure 4A:
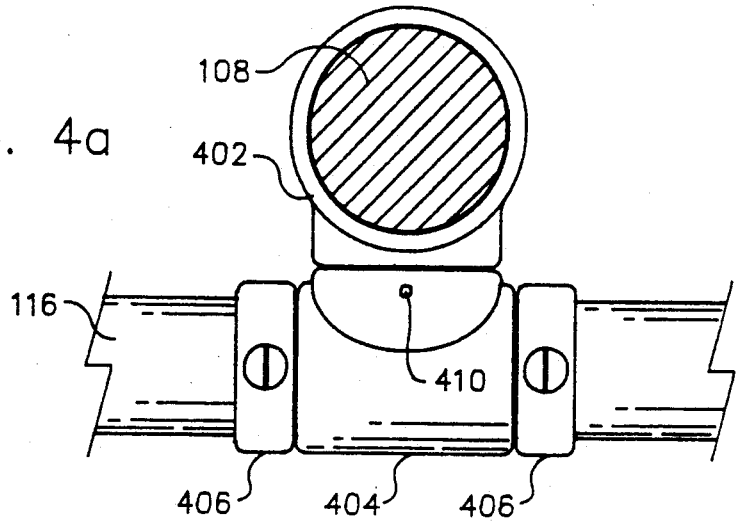
FIGS. 4*a* and 4*b* is a side view and a partially exposed side view respectively of the outrigger support and handle connector sleeve of the present invention, in which the longitudinal dimension of the outrigger support is perpendicular to the drawing.
Figure 4B:
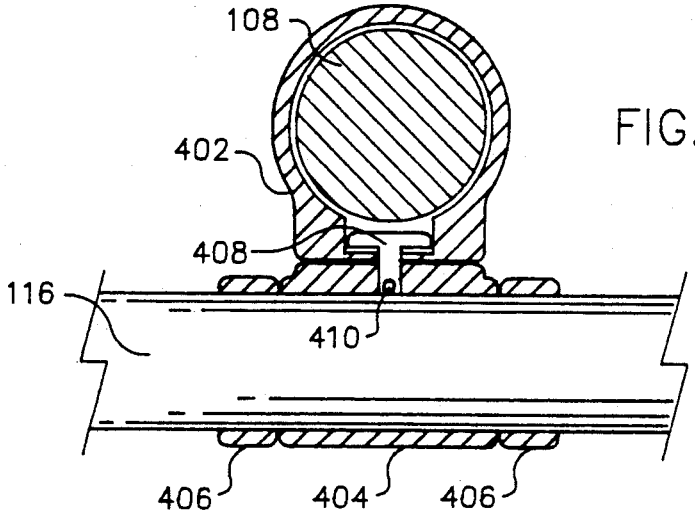
Figure 4C:
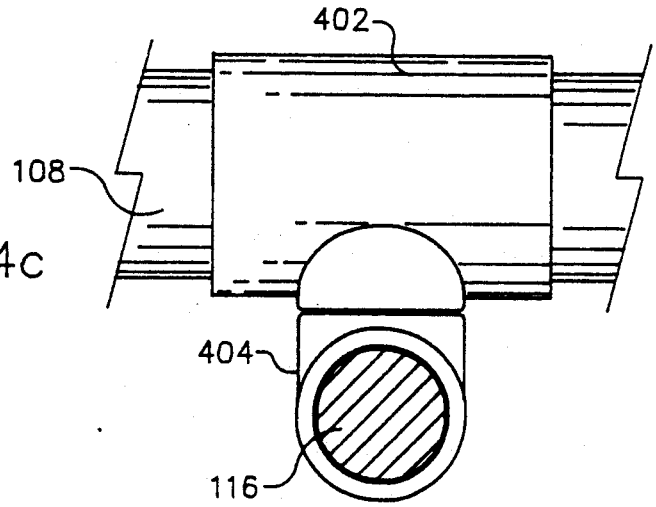
FIG. 4c is a side view of the outrigger support and handle connector sleeve of the present invention, in which the longitudinal dimension of the handle is perpendicular to the drawing.

Referring now to FIGS. 4*a*, 4*b* and 4*c*, the outrigger support and handle connector sleeves 114 are described in detail. Handle sleeve 404 is held in place on handle 116 by handle sleeve collars 406 fixedly attached to handles 116 in such fashion that handle sleeve 404 can rotate around handle 116 but cannot slide along handle 116 in either direction. Outrigger support sleeve 402 is slidably mounted over outrigger support 108 such that outrigger support sleeve 402 is free both to slide along and to rotate around outrigger support 108. Handle sleeve 404 and outrigger support sleeve 402 are pivotally connected to each other by sleeve axle 408, a clevis pin which is mounted through outrigger support sleeve 402 and fixedly attached to handle sleeve 404 by lock pin 410 passing therethrough. In this manner, angular movement of handles 116 causes pivotal movement of handle sleeve 404 with respect to outrigger support sleeve 402 and thus results in pivoting of handles 116 with respect to outrigger support 108.

Figure 5B:
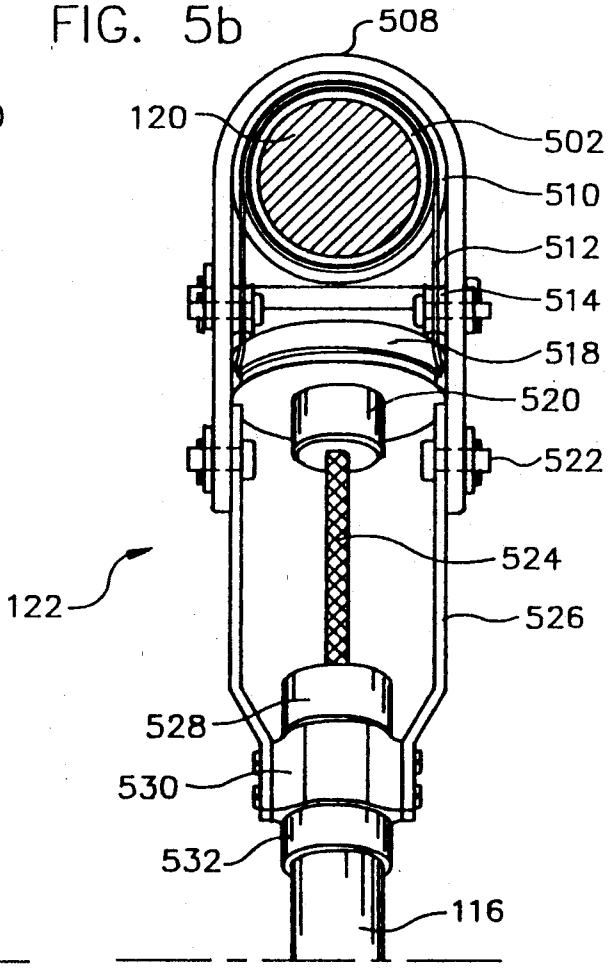
FIGS. 5a and 5b are top partially exposed and end views respectively of the preferred embodiment of the handle and oar connector of the present invention.
Figure 5A:
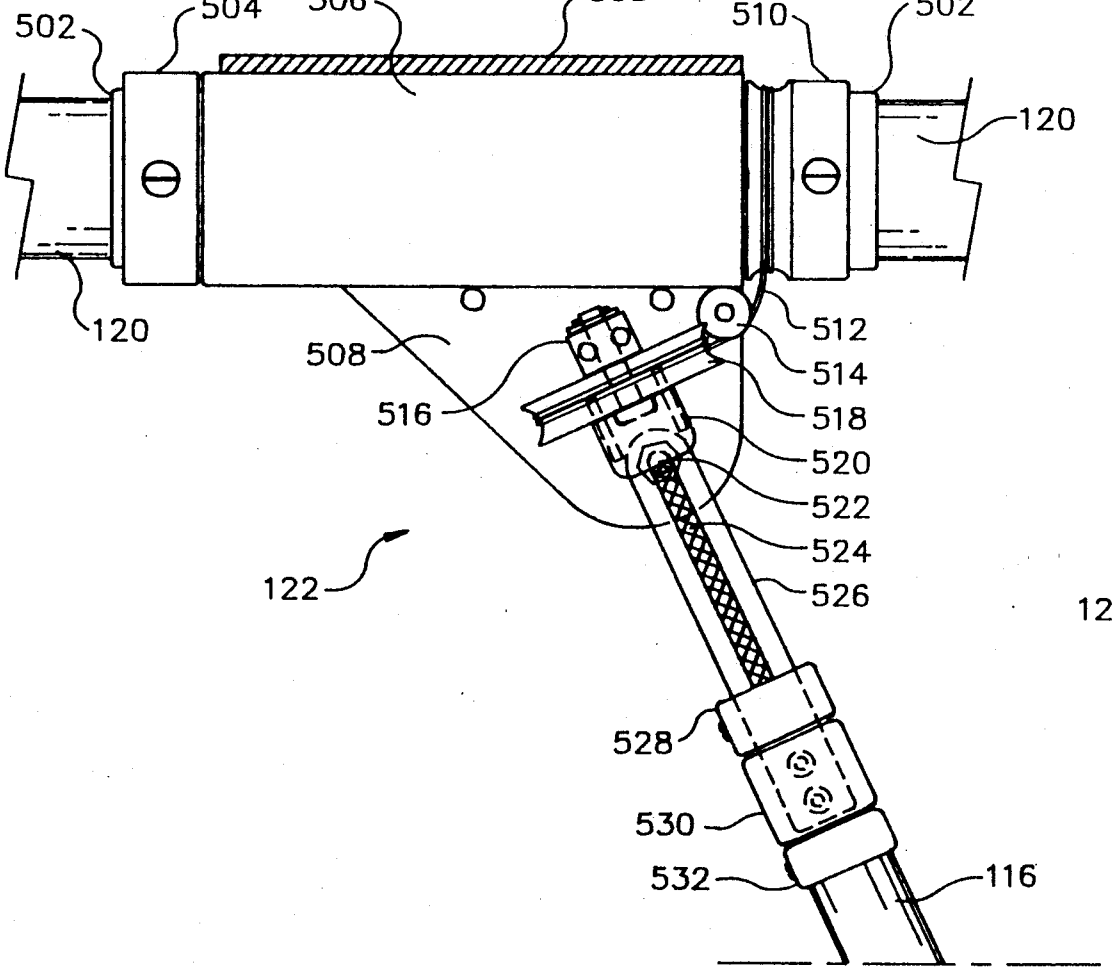

Referring now to FIGS. 5*a* and 5*b*, the handle and oar connectors 122 are described in detail. Mid-oar inner sleeve 502 is fixedly attached to oar 120, providing a surface around which mid-oar outer sleeve 506 can freely rotate. Mid-oar outer sleeve 506 is prevented from sliding along mid-oar inner sleeve 502 in the outboard direction by mid-oar sleeve collar 504 fixedly connected to mid-oar inner sleeve 508, and in the inboard direction by oar pulley 510 fixedly connected to mid-oar inner sleeve 502. Mid-oar outer sleeve 506 is fixedly attached to oar plate 508. Handle plates 526 are attached to oar plate 508 by plate clevis pins 522, thus allowing pivotal movement of handle 116 with respect to oar 120 in the plane shared by handle 116 and oar 120. Handle plates 526 are fixedly attached to protruding sides of handle plate sleeve 530. Handle plate sleeve 530 is mounted over handle 116 and is secured thereon by handle sleeve collars 528 and 532 fixedly attached to handle 116 in sueh fashion that handle plate sleeve 530 can rotate freely around handle 116 without being able to slide along it in either direction.

Flexible drive shaft 524 is fixedly attached to end of handle 116 adjacent to oar 120, such that flexible drive shaft 524 rotates in conjunction with handle 116. The end of flexible drive shaft 524 not connected to handle 116 is fixedly connected to pulley connector 520, which is fixed in turn to oar plate pulley 518. Oar plate pulley 518 is secured to oar plate 508 by mounting post 516. Belt 512, preferably an alloy cable, is looped over oar plate pulley 518, wrapped over secondary pulleys 514 attached to oar plate 508, and fastened to oar shaft pulley 510 on oar 120. Rotation of handle 116 thus causes rotation of flexible drive shaft 524 and oar plate pulley 518. The rotation of oar plate pulley 518 causes movement of belt 512 over secondary pulleys 514 and oar shaft pulley 510, which in turn causes rotation of oar 120. Rotation of oar 120 may be either in the same direction as rotation of handle 116 (i.e. clockwise or counterclockwise) or in the opposite direction, depending on whether belt 512 is placed over oar plate pulley 518, secondary pulleys 514, and oar shaft pulley 510 in a single loop configuration or in a twisted "figure-eight" configuration. Preferably, rotation of handles 116 in one direction, e.g. clockwise looking from the oarsman's perspective, will result in rotation of the oar blade 124 in the same direction, i.e. clockwise looking from the inboard end of the oar.

Figure 6B:
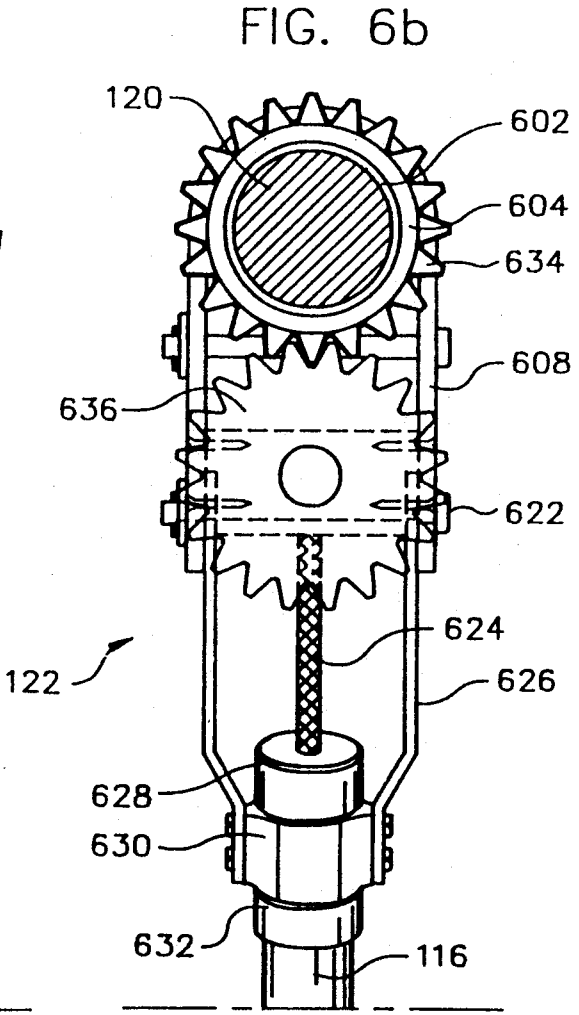
FIGS. 6a and 6b are top partially exposed and end views of another embodiment of the handle and oar connector of the present invention.
Figure 6A:
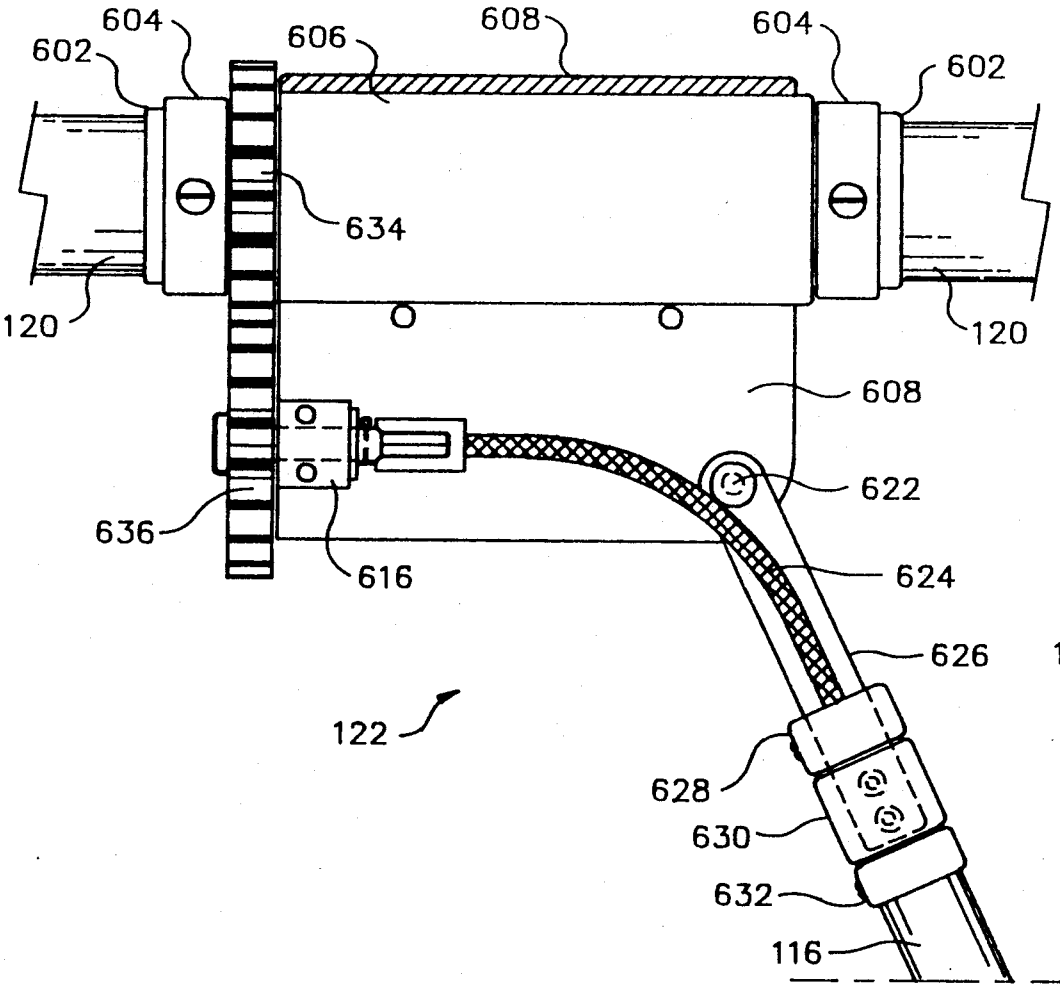
Figure 7A:
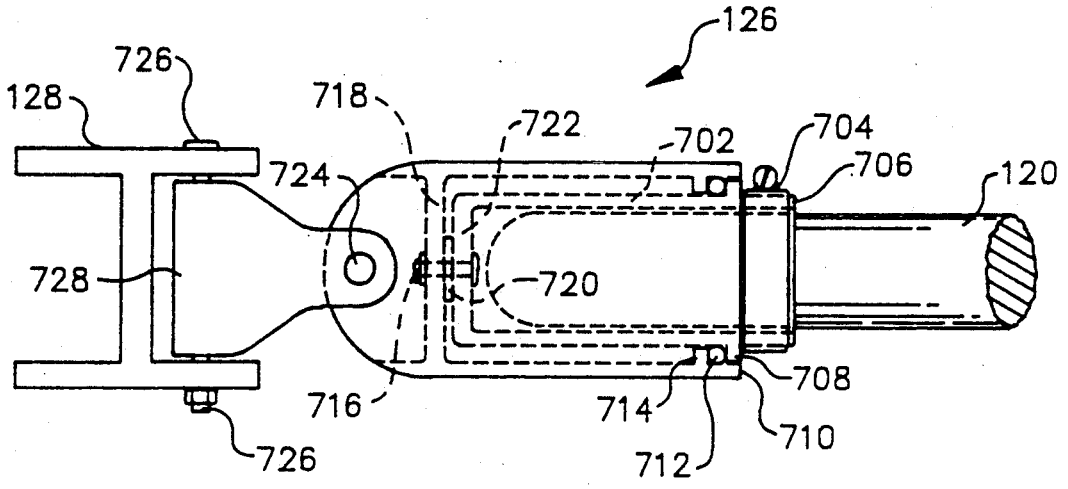
FIGS. 7a and 7b are top and side partially exposed views respectively of the oar and boat connector of the present invention.
Figure 7B:
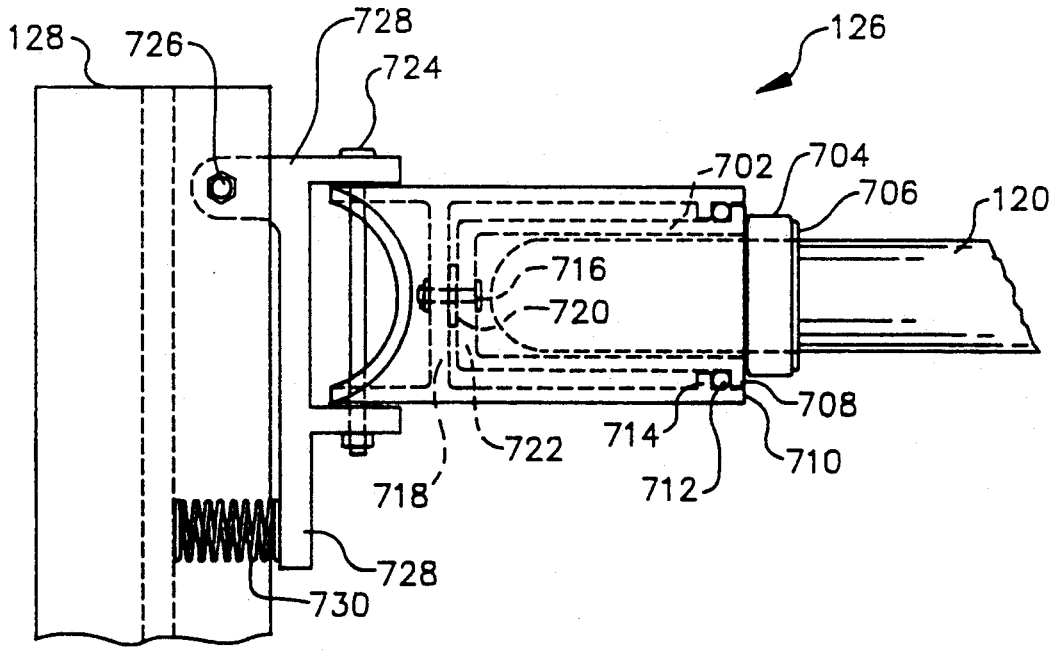
Figure 8A:
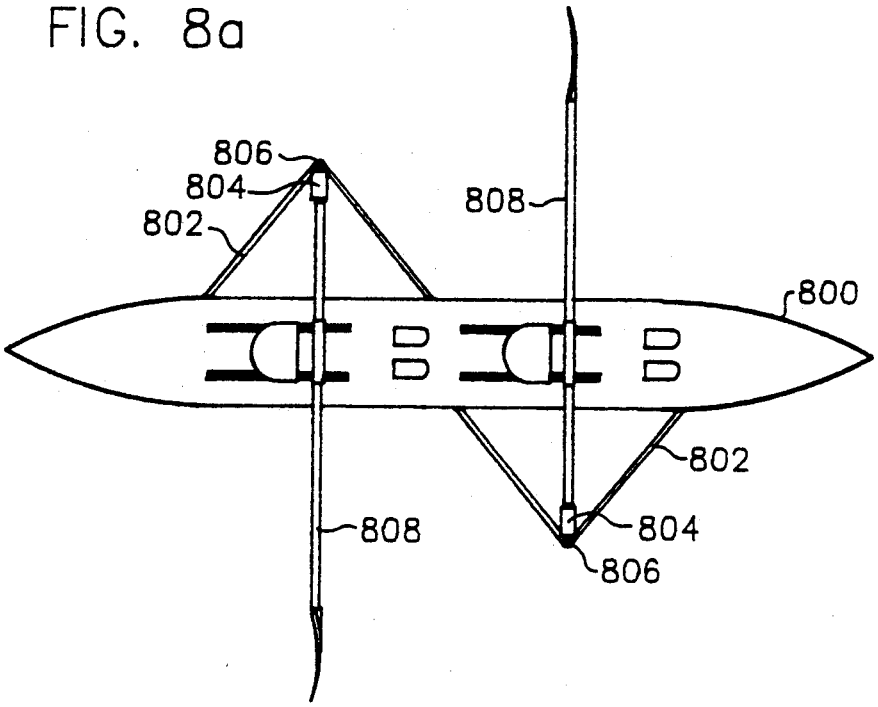
FIGS. 8a and 8b are top and side views respectively of an alternate embodiment of the present invention mounted on a "sweeps" racing shell.
Figure 8B:
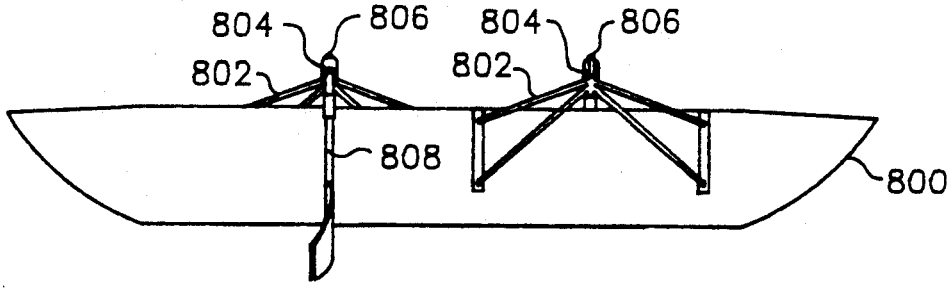
Figure 8C:
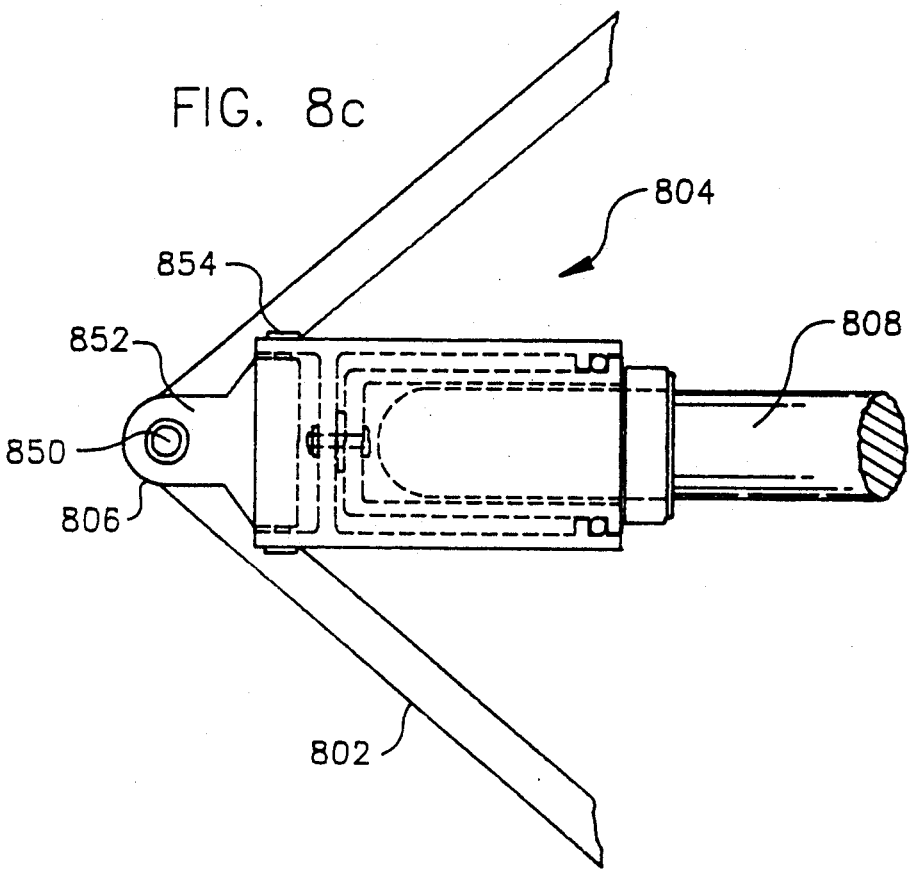
FIGS. 8c and 8d are top and side partially exposed views respectively of the oar and bracket connector of FIGS. 8a and 8b.
Figure 8D:
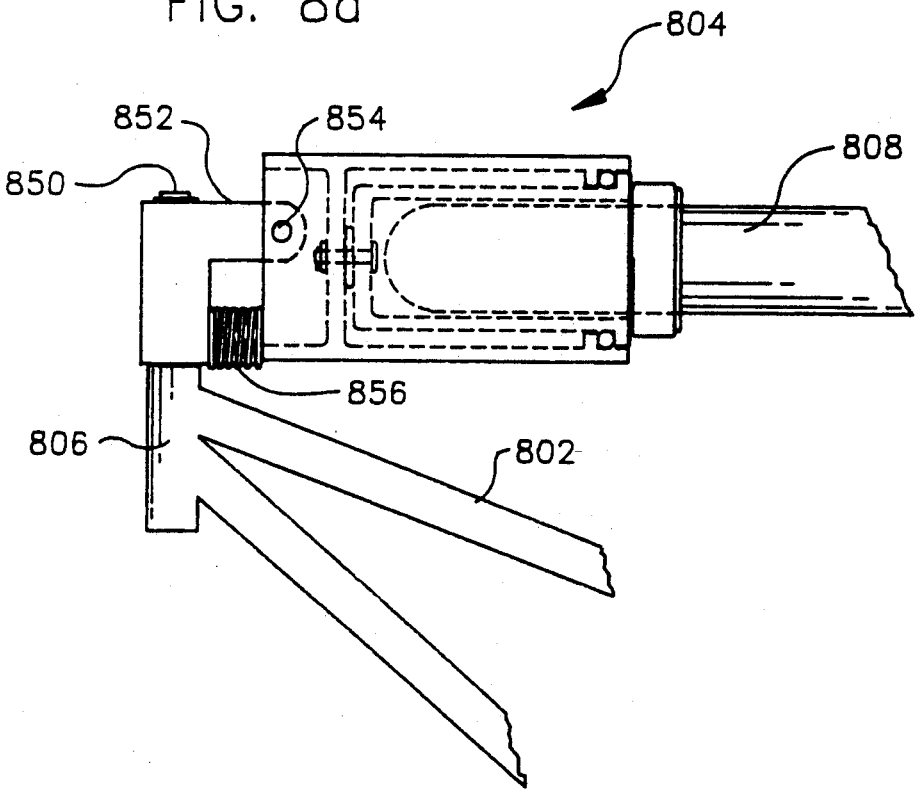

Referring to FIGS. 6*a* and 6*b*, an alternate embodiment of the handle and oar connectors 122 of the present invention is now described in detail. All of the elements common to both FIGS. 5*a–b* and FIGS. 6*a–b* are numbered in FIGS. 6*a–b* with the same second and third numerals as those in FIGS. 5*a–b*, but with the first numeral of "6" instead of "5." Thus, for example, mid-oar inner sleeve 502 of FIGS. 5*a–b* is mid-oar inner sleeve 602 in FIGS. 6*a–b*. All of the elements described in conjunction with the handle and oar connector 122 embodiment of FIGS. 5*a–b* are present in FIGS. 6*a–b*, with the exception that oar plate pulley 518, secondary pulleys 514, and oar shaft pulley 510, and belt 512 in FIGS. 5*a–b* are replaced with oar plate gear 636 and and oar shaft gear 634 in FIGS. 6*a–b*.

In operation the embodiment of FIGS. 6*a–b* rotates oar 120 when handle 116 is rotated based on the concommitant rotation of flexible drive shaft 624, which rotates oar plate gear 636. Oar shaft gear 634, which meshes with oar plate gear 636, thus rotates and in turn rotates oar 120. It is readily apparent that a greater number of gears than the two oar plate gear 636 and oar shaft gear 634 may be employed. Also, it is apparent that the rotational direction of oar 120 (i.e. clockwise or counterclockwise) may be either the same as or opposite to the rotational direction of handle 116 depending on whether an odd or an even number of gears is employed.

Referring now to FIGS. *7a* and *7b*, the oar and boat connectors 126 are described in detail. Oar 120 is fixedly secured in inner sleeve 702 of oar and boat connector 126 by clamp 704 fixedly secured to exposed sleeve end 706 of inner sleeve 702. Inner sleeve 702 is located within outer sleeve 710 such that outer annular lip 708 of inner sleeve 702 is offset from inner annular lip 714 of outer sleeve 710. Ball bearings 712 reside in the space between outer annular lip 708 of inner sleeve 702 and inner annular lip 714 of outer sleeve 710. Inner sleeve 702 is secured to outer sleeve 710 by oar sleeve axle 716, a clevis pin which passes through sleeve end 722 of inner sleeve 702, through separating washer 720, and through anchor wall 718 of outer sleeve 710. Inner sleeve 702 is thus free to rotate relative to outer sleeve 710 around oar sleeve axle 716 and on ball bearings 712, and in this manner provides free rotation of oar 120.

The inboard end of outer sleeve 710 is pivotally connected by oar stroke axle 724, a substantially vertically disposed clevis pin, to spring-loaded hinge piece 728. Outer sleeve 708 pivots horizontally around oar stroke axle 724, providing horizontal movement of inner sleeve 702 and oar 120 relative to scull 100.

Spring-loaded hinge piece 728 is pivotally connected by oar elevation axle 726, a substantially horizontal clevis pin, to oar support post 128. Preferably, oar support post 128 is channelled so as to receive oar elevation axle 726 directly; however, it is readily apparent that if oar support post were not so formed, a bracket could be affixed to it to receive oar elevation axle in a similar manner. Oar elevation axle 726 provides pivotal movement in a vertical axis of spring-loaded hinge piece 728, outer sleeve 710, inner sleeve 702, and oar 120 relative to scull 100. Spring 730, connected to spring-loaded hinge piece 728 and to oar support post 128, is biased against the weight of oar 120. Spring 730 preferably has a bias force sufficient to cause the heft of oar 120 to be less than or equal to the heft of an oar mounted to scull 100 in the conventional fashion, at the "leather."

It is thus readily apparent that rotational and complete pivotal movement of oar 120 relative to scull 100 is attainable, with rotation accomplished by movement of inner sleeve 702 in outer sleeve 710, horizontal movement accomplished by movement of outer sleeve 710 around oar stroke axle 724, and vertical movement accomplished by movement of spring-loaded hinge piece 728 around oar elevation axle 726.

Referring now to FIGS. *8a* through *8d*, an alternate embodiment of the present invention for use on "sweeps" racing shells is described in detail. In "sweeps" rowing, each oarsman wields a single oar. Traditionally such oarsmen sit facing towards the stern of the racing shell. In the present embodiment of FIGS. *8a* through *8d*, the oarsmen would face the bow. Also, traditionally, each oar is pivotally attached in the midsection of the oar to an outrigger on the side of the racing shell, and the oarsman grasps the oar end. In the present embodiment of FIGS. *8a* through *8d*, the oarsman grasps the oar in the midsection, the oar is attached at an end to an outrigger on the side of the racing shell, and the oar passes across the width of the racing shell. While places for only two oarsmen are illustrated in FIGS. *8a* and *8b*, it is readily apparent that the configuration shown for two oarsmen could be repeated for any higher even number of oarsmen that a racing shell might accommodate.

Specifically, racing shell 800 has outrigger 802 fixedly attached thereto. Outrigger 802 is an oar attaching component known in the art, with the difference that outrigger 802 stands off somewhat farther from the side of racing shell 800 than do conventional outriggers, and is elevated higher above the water at its outboard end than are conventional outriggers. Outrigger 802 is attached to the side of racing shell 800 by bolts in a fashion known in the art.

As shown in FIGS. *8c* and *8d*, oar and outrigger connector 804 is connected to outboard end of outrigger 802. Oar and outrigger connector 804 is configured identically to oar and boat connector 126 in respect to its outer and inner sleeves which allow oar rotation, and all of the elements thereof are incorporated by reference into the description of oar and outrigger connector 804. Oar and outrigger connector 804 is otherwise similar to oar and boat connector 126 excepting only that the pivotal motions of the oar are differently provided for, as follows. The axle allowing horizontal pivotal motion of the oar 808, i.e. sweep axle 850, is attached substantially vertically to the outboard end 806 of outrigger 802 in a fashion known in the art, and the sweeps hinge piece 852 is mounted on it such that sweeps hinge piece 852 can pivot horizontally around it with respect to shell 800. The axle allowing vertical pivotal motion of the oar 808, i.e. sweeps lift axle 854, connects sweeps hinge piece 854 to the outer sleeve of oar and outrigger connector 804 such that the sleeves of oar and outrigger connector 804, together with oar 808, can pivot vertically with respect to shell 808. Sweeps spring 856 is mounted between sweeps hinge piece 852 and the outer sleeve of oar and outrigger connector 804, biased against the weight of oar 808 to provide a heft roughly comparable to that of a conventionally mounted sweeps oar.

In operation, each oarsman uses substantially the normal rowing motion used in conventional sweeps rowing, except that in order to raise the blade of oar 808, he raises his hands as opposed to lowering them, and in order to lower the blade of oar 808, he lowers his hands as opposed to raising them. Also, in "feathering" the blade of the oar, he must rotate the oar in the opposite direction to that in which he would rotate it in a conventional configuration. In all other respects, he uses the same motion as is normally used in conventional sweeps rowing.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the spirit and scope of the invention.

I claim:

1. An apparatus for use in forward facing rowing of a boat having oars mounted ahead of the oarsman, said apparatus comprising:

oar and boat attachment means pivotally attaching the oar to the boat;

elongate handle means to be gripped by the oarsman, said elongate handle means being pivotable, rotatable, and movable along its longitudinal axis;

elongate handle rotation transfer means attaching said elongate handle means to the oar whereby rotational, pivotal, and longitudinal axial motion by said elongate handle means is transferred to the oar to cause rowing motion of the oar in response to movement of said elongate handle means by the oarsman, including feathering of the oar in response to rotation of said elongate handle means.

2. An apparatus for use in forward facing rowing of a boat having oars, said apparatus comprising:

elongate outrigger support means extending outwardly from a boat and adapted for horizontal pivotal movement relative to the boat;

outrigger support and handle attachment means including a sleeve means slidably mounted over said elongate outrigger support means;

elongate handle means adapted to be gripped by an oarsman, said elongate handle means pivotally connected to said sleeve means for pivotal movement relative to said elongate outrigger support means, said sleeve means guiding movement of said elongate handle means along the length of said elongate outrigger support means;

handle and oar attachment means pivotally connecting said elongate handle means to the oar, said handle and oar attachment means including a rotation transferring means causing corresponding rotation of the oar upon rotation of said elongate handle means, said handle and oar attachment means transferring movement from said elongate handle means to the oar as said elongate handle means rotates, pivots relative to said elongate outrigger support means, and travels with said sleeve means along the length of said elongate outrigger support means; and oar and boat attachment means pivotally attaching the oar to the boat.

3. The apparatus of claim 2 wherein said oar and boat attachment means includes biasing means disposed against the weight of the oar.

4. The apparatus of claim 2 wherein said oar and boat attachment means comprises:

a first sleeve over the inboard end of the oar;

a second sleeve over said first sleeve, said second sleeve allowing rotation of said first sleeve and the oar relative to said second sleeve;

a hinge assembly connecting said second sleeve to the boat, said hinge assembly comprising:

a first axle through said second sleeve for pivotal movement of said second sleeve and the oar backward and forwards relative to the boat, said first axle being substantially perpendicular to the oar;

a hinge arm connected to said first axle; a second axle through said hinge arm for pivotal movement of said hinge arm and the oar upwards and downwards relative to the boat, said second axle being substantially perpendicular to said first axle and to the oar; and a support member connecting said second axle to the body of the boat; and a spring connected to said hinge arm and said support member, said spring biased against the weight of the oar.

5. The apparatus of claim 2 wherein said elongate handle means has an outboard end, and said rotation transferring means of said handle and oar attachment means comprises:

a pulley wheel adjacent to said outboard end of said elongate handle means;

a flexible shaft connecting said pulley wheel and said outboard end of said elongate handle means so that rotation of said elongate handle means causes rotation of said pulley wheel; and a belt around said pulley wheel and around the oar so that rotation of said pulley wheel causes rotation of said oar.

6. The apparatus of claim 5 wherein said elongate handle means has an inboard end and the oar has an outboard blade end, and said belt is oriented around said pulley wheel and the oar to cause rotation at the outboard blade end of the oar in the same direction as rotation of said inboard end of said elongate handle means.

7. The apparatus of claim 2 wherein said elongate handle means has an outboard end and said rotation transferring means of said handle and oar attachment means comprises:

a first gear having first teeth, said first gear adjacent to said outboard end of said elongate handle means;

a flexible shaft connecting said first gear and said outboard end of said elongate handle means so that rotation of said elongate handle means causes rotation of said first gear; and second teeth circumferentially disposed around the oar and defining a second gear aligned with said first gear, said second teeth in meshing engagement with said first teeth on said first gear so that rotation of said first gear causes rotation of the oar.

8. An apparatus for forward facing rowing comprising:

a boat having an inboard portion;

an oar having an inboard end and an outboard blade end;

an elongate outrigger support extending outwardly from a mounting point on said boat having an end adjacent to said mounting point, said end of said elongate outrigger support adapted for horizontal pivotal movement of said elongate outrigger support therearound;

an outrigger support and handle connector including a sleeve slidably mounted over said elongate outrigger support;

an elongate handle having an inboard end and an outboard end, said elongate handle adapted to be gripped by an oarsman at said inboard end, said elongate handle pivotally connected to said sleeve for pivotal movement relative to said sleeve and said elongate outrigger support, said sleeve guiding movement of said elongate handle along the length of said elongate outrigger support;

a handle and oar connector that pivotally connects said outboard end of said elongate handle to said oar at an inner portion of said oar, said handle and oar connector including a rotation transferring mechanism causing corresponding rotation of said oar upon rotation of said elongate handle, said handle and oar connector transferring from said elongate handle to said oar pivotal and rotational movement as said elongate handle rotates, pivots relative to said elongate outrigger support, and travels with said first sleeve along the length of said elongate outrigger support; and an oar and boat connector that connects said inboard end of said oar to said inboard portion of said boat, said oar and boat connector allowing rotational and pivotal movement of said oar relative to said boat at said inboard end of said oar for rowing motion by said oar in response to movement by said elongate handle.

9. The apparatus of claim 8 wherein said oar and boat connector includes a spring connected to said inboard portion of said boat and to said inboard end of said oar, said spring biased against the weight of said oar.

10. The apparatus of claim 8 wherein said oar and boat connector comprises:

a first sleeve over said inboard end of said oar;

a second sleeve in coaxial alignment with and over said first sleeve, said second sleeve allowing rotation of said first sleeve and said oar relative to said second sleeve; a hinge assembly connecting said second sleeve to said boat, said hinge assembly comprising:

a first axle through said second sleeve for pivotal movement of said second sleeve and said oar backward and forwards relative to said boat;

a hinge arm connected to said first axle;

a second axle substantially perpendicular to said first axle and to said oar; and a support member connecting said second axle to said boat; and a spring connected to said hinge arm and said support member, said spring biasing against the weight of said oar.

11. The apparatus of claim 8 wherein said rotation transferring mechanism of said handle and oar connector comprises:

a pulley wheel adjacent to said outboard end of said elongate handle;

a flexible shaft connecting said pulley wheel and said outboard end of said elongate handle so that rotation of said elongate handle causes rotation of said pulley wheel; and a belt around said pulley wheel and around said oar so that rotation of said pulley wheel causes rotation of said oar.

12. The apparatus of claim 11 wherein said belt is oriented around said pulley wheel and said oar to cause rotation at said outboard blade end of said oar in the same direction as rotation of said inboard end of said elongate handle.

13. The apparatus of claim 8 wherein said rotation transferring mechanism of said handle and oar connector comprises:

a first gear having first teeth, said first gear adjacent to said outboard end of said elongate handle;

a flexible shaft connecting said first gear and said outboard end of said elongate handle so that rotation of said elongate handle causes rotation of said first gear; and second teeth circumferentially disposed around said oar and defining a second gear aligned with said first gear, said second teeth in meshing engagement with said first teeth on said first gear so that rotation of said first gear causes rotation of said oar.

14. An apparatus for forward facing rowing comprising:

a boat having sidewalls;

an oar adapted to be gripped by an oarsman and having an outrigger end and a blade end;

an outrigger attached to the sidewall of the boat;

an oar-to-outrigger connector attaching said outrigger to said outrigger end of said oar so that said oar is disposed across said boat with said blade end of said oar on an opposite side of said boat from said outrigger end of said oar, said oar to outrigger connector allowing pivotal and rotational movement of said oar by an oarsman, said oar to outrigger connector comprising:

a first sleeve over said outrigger end of said oar;

a second sleeve in coaxial alignment with and over said first sleeve, said second sleeve allowing rotation of said first sleeve and said oar relative to said second sleeve;

a hinge assembly connecting said second sleeve to said boat, said hinge assembly comprising:

a first axle through said second sleeve for pivotal movement of said second sleeve and said oar upwards and downwards relative to said boat;

a hinge arm connected to said first axle;

a second axle substantially perpendicular to said first axle and to said oar;

a support member connecting said second axle to said boat; and a spring connected to said hinge arm and said second sleeve, said spring biasing against the weight of said oar.

15. The apparatus of claim 1 further comprising:

elongate outrigger support means extending outwardly from the boat and adapted for horizontal pivotal movement relative to the boat; and outrigger support and handle attachment means including a sleeve means slidably mounted over said elongate outrigger support means, said elongate handle means pivotally connected to said sleeve means for pivotal movement relative to said elongate outrigger support means, said sleeve means guiding movement of said elongate handle means along the length of said elongate outrigger support means whereby said elongate handle rotation transfer means transfers movement from said elongate handle means to the oar as said elongate handle means rotates, pivots relative to said elongate outrigger support means, and travels with said sleeve means along the length of said elongate outrigger support means.

16. The apparatus of claim 1 wherein said oar and boat attachment means includes biasing means disposed against the weight of the oar.

17. The apparatus of claim 1 wherein said oar and boat attachment means comprises:

a first sleeve over the inboard end of the oar;

a second sleeve over said first sleeve, said second relative to said second sleeve;

a hinge assembly connecting said second sleeve to the boat, said hinge assembly comprising:

a first axle through said second sleeve for pivotal movement of said second sleeve and the oar backward and forwards relative to the boat, said first axle being substantially perpendicular to the oar;

a hinge arm connected to said first axle;

a second axle through said hinge arm for pivotal movement of said hinge arm and the oar upwards and downwards relative to the boat, said second axis being substantially perpendicular to said first axle and to the oar; and a support member connecting said second axle to the body of the boat; and a spring connected to said hinge arm and said support member, said spring biased against the weight of the oar.

18. The apparatus of claim 1 wherein said elongate handle means includes an outboard end and said elongate handle rotation transfer means comprises:

a pulley wheel adjacent to said outboard end of said elongate handle means;

a flexible shaft connecting said pulley wheel and said outboard end of said elongate handle means so that rotation of said elongate handle means causes rotation of said pulley wheel; and a belt around said pulley wheel and around the oar so that rotation of said pulley wheel causes rotation of said oar.

19. The apparatus of claim 18 wherein said elongate handle means has an inboard end and the oar has an outboard blade end, and said belt is oriented around said pulley wheel and the oar to cause rotation at the outboard blade end of the oar in the same direction as rotation of said inboard end of said elongate handle means.

20. The apparatus of claim 1 wherein said elongate handle means has an outboard end and said elongate handle rotation transfer means comprises:

a first gear having first teeth, said first gear adjacent to said outboard end of said elongate handle means;

a flexible shaft connecting said first gear and said outboard end of said elongate handle means so that rotation of said elongate handle means causes rotation of said first gear; and second teeth circumferentially disposed around the oar and defining a second gear aligned with said first gear, said second teeth in meshing engagement with said first teeth on said first gear so that rotation of said first gear causes rotation of the oar.

21. An apparatus for forward facing rowing by an oarsman comprising:

a boat;

an oar;

oar and boat attachment means pivotally attaching said oar to said boat;

elongate handle means to be gripped by the oarsman, said elongate handle means being pivotable, rotatable, and movable along its longitudinal axis;

elongate handle rotation transfer means attaching said elongate handle means to said oar whereby rotational, pivotal, and longitudinal axial motion by said elongate handle means is transferred to said oar to cause rowing motion of said oar in response to movement of said elongate handle means by the oarsman, including feathering of said oar in response to rotation of said elongate handle means.

* * * * *